United States Patent [19]

Adams et al.

[11] Patent Number: 4,852,823

[45] Date of Patent: Aug. 1, 1989

[54] YARN TUBE WITH IDENTIFICATION MEANS AND WINDING METHOD UTILIZING SUCH TUBE

[75] Inventors: Samuel F. Adams; Hans-Peter Bolz, both of Greenville, S.C.

[73] Assignee: Sonoco Products Company, Hartsville, S.C.

[21] Appl. No.: 269,562

[22] Filed: Nov. 10, 1988

[51] Int. Cl.[4] ..... B65H 75/28; B65H 75/10

[52] U.S. Cl. ..... 242/125.1; 242/1; 242/18 PW; 242/118.3; 242/164; 40/309

[58] Field of Search ..... 242/125.1, 125.2, 125.3, 242/18 PW, 18 EW, 164, 165, 172, 118.3, 118.31, 118.32, 1; 40/309

[56] References Cited

U.S. PATENT DOCUMENTS

| | | | |
|---|---|---|---|
| 1,851,314 | 3/1932 | Knoche | 242/125.1 |
| 2,026,032 | 12/1935 | Gottlieb | 242/118.3 X |
| 2,079,966 | 5/1937 | Reiners et al. | 242/125.1 |
| 2,359,604 | 10/1944 | Atwood | 242/118.31 X |
| 2,987,267 | 6/1961 | Hayes et al. | 242/125.1 |
| 3,033,489 | 5/1962 | Morris | 242/118.32 |
| 3,425,149 | 2/1969 | Fletcher | 242/118.32 X |
| 3,592,407 | 7/1971 | Hagmann | 242/118.3 |
| 3,625,451 | 12/1971 | Anderson | 242/125.1 |
| 3,677,492 | 7/1972 | Ueda et al. | 242/125.1 X |
| 3,814,347 | 6/1974 | Moren, Jr. | 242/125.1 |
| 3,955,775 | 5/1976 | Egyptien et al. | 242/125.1 |
| 3,986,680 | 10/1976 | Cardell | 242/125.1 |
| 4,018,401 | 4/1977 | Cunningham | 242/118.3 |
| 4,040,572 | 8/1977 | Melan et al. | 242/125.1 X |
| 4,063,696 | 12/1977 | Kelly et al. | 242/125.1 |
| 4,184,653 | 1/1980 | Bonzo | 242/125.1 |

*Primary Examiner*—Stanley N. Gilreath

*Attorney, Agent, or Firm*—Bell, Seltzer, Park & Gibson

[57] ABSTRACT

This invention relates to a yarn carrier with means for catching the end of a yarn and also for providing an identification of a particular characteristic of the yarn. The catching and identifying means comprises a radially extending opening through the peripheral wall of the yarn carrier arranged to receive a color coded insert. The combination of the insert and the opening additionally form oppositely directed yarn engaging notches for catching and retaining the free end of the yarn to be wound on the carrier.

10 Claims, 1 Drawing Sheet

YARN TUBE WITH IDENTIFICATION MEANS AND WINDING METHOD UTILIZING SUCH TUBE

FIELD OF THE INVENTION

This invention is directed to a yarn carrier for receiving and supporting yarn thereon and more particularly to a yarn carrier with a yarn catching and identifying means to both catch the end of the yarn and provide a visual identification of a particular characteristic of the yarn.

BACKGROUND OF THE INVENTION

In production textile mills, a wide variety of yarns are available to produce an array of textile products. Unfortunately, many of these various textile yarns are not clearly distinguishable from one another which makes inventory control a very difficult problem. The yarn packages must be carefully marked or labelled or reliably maintained in compartments or racks that are clearly marked.

Several arrangements which provide a color coded attachment to the yarn carrier have been proposed to identify the different yarns. For example, Gottlieb U.S. Pat. No. 2,026,032 shows a spool with a color coded cap attached to the end of the spool. Morris U.S. Pat. No. 3,033,489 and Fletcher No. 3,425,149 show inserts which are received in the hollow ends of the textile carriers. Each of these arrangements, however, extends out and away from the yarn carrier putting the color coded identification portions in a position potentially to be knocked off the yarn carrier. In production textile mills, yarn packages are handled sometimes in a rough manner and it is likely that if the identification can be knocked off, it will.

Other more complicated devices for identifying the particular type of yarn and the yarn carrier include Atwood U.S. Pat. No. 2,359,604 and Hagmann No. 3,592,407, et al. Atwood shows a textile spool with a metallic end member crimped on to the end. An identification disk may be received into the end of the metallic end member and held in place by several projections. Hagmann shows a two piece color coded insert for the end of a bobbin wherein each of the two pieces are separately color coded to identify the yarn. The two pieces are joined together to provide a more secure fit on the end of the bobbin. Hagmann, however, extends out and away from the bobbin and is likely to be knocked out accidentally. Atwood has the identification insert received down deep into the spool where it is difficult to manipulate the identification disk in and out.

An additional problem with yarn packages is retaining the end or tail of the yarn during subsequent processing or shipment. This is commonly accomplished by providing an angular cut at the edge of the bobbin or spool, and sliding the yarn into the cut to catch and hold the yarn securely. Examples of such devices include Egyptien U.S. Pat. 3,955,775, et al., Kelly 4,063,696, et al., and Cunningham No. 4,018,401. However, providing the angular cuts at the edge of the spool will interfere with the coded end caps as discussed above.

Accordingly, it is an object of the present invention to provide a yarn carrier having a single means for both identifying the particular type of yarn which is wound on the carrier, and for catching the free yarn end, and while avoiding the drawbacks of the prior art as discussed above.

It is also an object of the present invention to provide a winding method utilizing a tube of the above type, and wherein the yarn identification means is visible on the finished package.

SUMMARY OF THE INVENTION

The above and other objects of the invention are accomplished by providing a yarn carrier comprising a tube having opposite ends and a peripheral wall for receiving a yarn to be wound thereon. The yarn carrier further has yarn catching and identifying means for retaining a free end of the yarn to be wound upon the peripheral wall and for identifying a particular characteristic of the yarn. In particular, the yarn catching and identifying means comprises an opening extending radially through the peripheral wall and communicating with one of the ends of the tube, and an insert removably received in said opening. The opening and the insert are configured to define at least one yarn engaging notch which is formed between the peripheries of the opening and the insert. The notch opens toward one of the ends of the tube so that a free end of the yarn can quickly and easily be caught and retained in the notch. Also, the insert includes a visual indicium for readily identifying a particular characteristic of the yarn to be wound upon the tube.

BRIEF DESCRIPTION OF THE DRAWINGS

Some of the features and advantages of the invention have been stated, and others will become apparent as the description proceeds when taken in conjunction with the accompanying drawings, in which.

DETAILED DESCRIPTION OF THE PREFERRED EMBODIMENT

Figure 1:
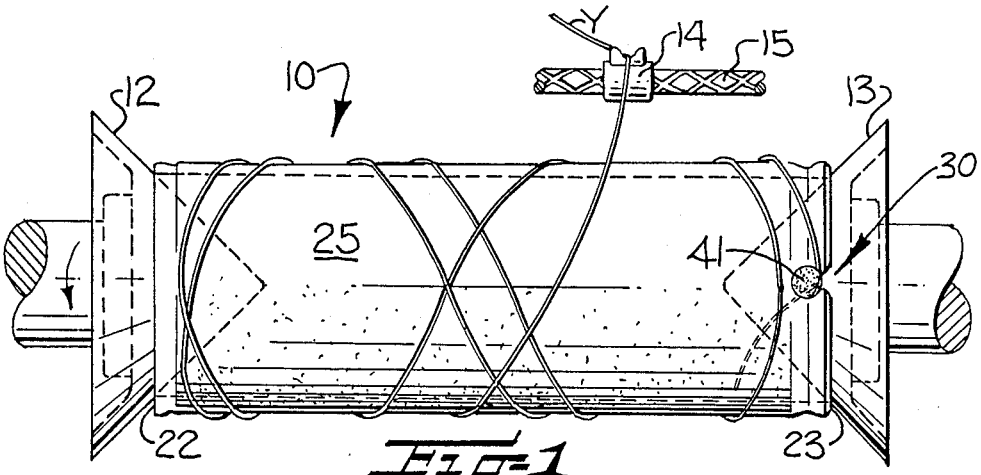
FIG. 1 is a front elevation view of the yarn carrier which embodies the features of the present invention mounted in a fragmentarily illustrated winding machine with a yarn being wound thereon.

Referring now more particularly to the drawings, a preferred embodiment of the yarn carrier 10, which embodies the features of the present invention, is illustrated in FIG. 1 mounted between the rotating spindles 12 and 13 of a winding machine. The winding machine is conventional, and includes a yarn guide 14 which reciprocates on a rotating guide shaft 15 along the length of the carrier.

Figure 2:
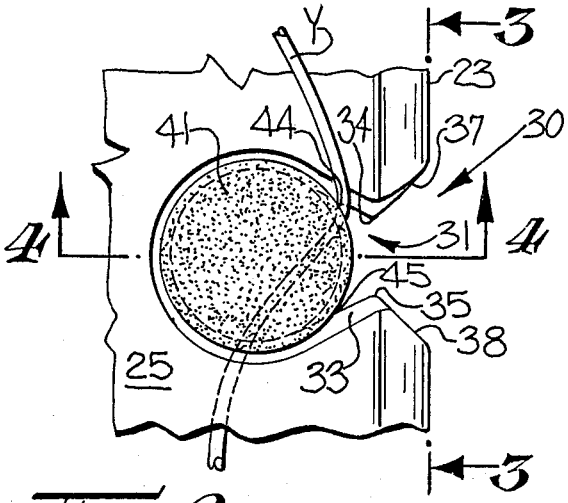
FIG. 2 is an enlarged fragmentary front elevation view of the yarn carrier specifically focusing on the yarn catching and identifying means.
Figure 3:
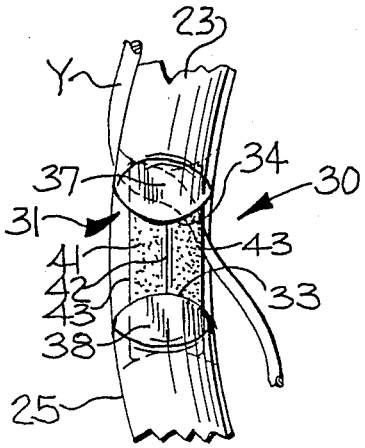
FIG. 3 is an enlarged fragmentary end view of the yarn carrier taken substantially along the line 3—3 in FIG. 2.
Figure 4:
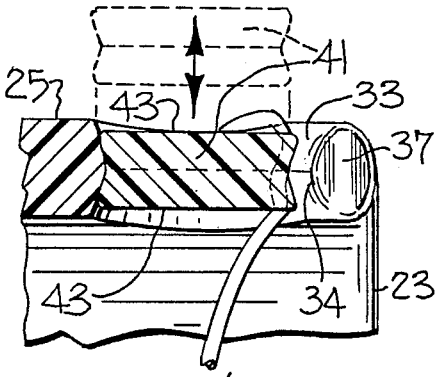
FIG. 4 is an enlarged fragmentary sectional view taken substantially along the line 4—4 in FIG. 2.

The yarn carrier 10 is preferably of molded plastic construction, and in the preferred embodiment it comprises a generally cylindrical tube with opposite open ends 22 and 23. However, the invention is also applicable to yarn carriers of conical configuration. The tube further has a peripheral wall 25 which preferably has a coarse or roughened surface to prevent the yarn from sliding along the wall 25 as the yarn is wound onto the carrier 10. In accordance with the present invention, the yarn carrier 10 includes a yarn catching and identifying means 30, which is best illustrated in FIGS. 2, 3 and 4. The yarn catching and identifying means comprises an opening 31 with an insert 41 received therein. The opening 31 extends radially through the peripheral wall 25 and has a complex shape somewhat similar to a keyhole. The portion most remote from the end 23 is generally circular shaped and it is this portion where the insert 41 is received. The opening continues from the circular shaped portion to a throat portion defined by points 34 and 35. The throat portion is the narrowest part of the opening such that the opening widens toward and communicates with the end 23 along V-shaped guide surfaces 37 and 38. Preferably, the opening 31 is formed in the tube during the molding process.

Figure 5:
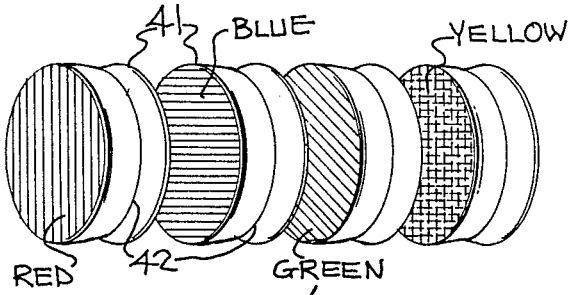
FIG. 5 is an enlarged front perspective view of a selection of various colored inserts of the yarn catching and identifying means.

The insert 41 is shaped as a circular disc which has a peripheral outline which closely conforms to the outline of the circular shaped portion of the opening 31. It should be understood that other suitable shapes such as an oblong or a rectangular shape are within the scope of the invention, but the circular shape comprises the preferred embodiment. Also, and as best seen in FIGS. 4 and 5, the insert 41 has a groove 42 around the outer peripheral edge thereof, and the circular portion of the opening 31 has an inwardly directed annular ridge 33 along an internal wall portion which is adapted to be received within the groove when the insert is inserted radially into the opening. Thus, the insert is securely and releasably received in the opening by the interengagement of the annular ridge and groove. Further, it will be seen that the disc has generally planar opposite faces 43, and a thickness which is slightly less than the thickness of the peripheral wall 25. Thus, the insert does not protrude from the outer surface of the wall 25, and is substantially flush therewith.

The insert 41 is preferably made of a resilient plastic material and should also be manufactured in several different colors as illustrated in FIG. 5. By prior selection, each color serves as an indicium for a particular characteristic of the yarn, such as the type of yarn, or the source, etc. The indicium may alternatively be a combination of colors, a printed code or other type of visual indicator.

The yarn catching and identifying means accomplishes two functions: to catch the free end of the yarn, and to identify a particular yarn characteristic. To perform the latter, a color coded insert is inserted into the opening which, by prior selection, indicates a particular characteristic of the yarn to be wound onto the yarn carrier. To catch the yarn, the particular arrangement of the insert within the opening 31 forms a pair of yarn engaging notches indicated by the numerals 44 and 45. The notches 44 and 45 are spaced apart along the periphery of the insert where the internal wall portion of the opening comes into contact with the circular periphery of the insert 41. The notches 44 and 45 accordingly face in opposite circumferential directions so that they may be used to hold the leading end of the yarn in either winding direction. Additionally, the yarn may be quickly and easily caught because of the wide opening in the end of the carrier defined by yarn guide surfaces 37 and 38.

Figure 6:
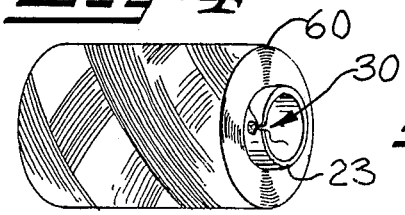
FIG. 6 is a front perspective view of a yarn package formed by a yarn wound onto the yarn carrier of the present invention.

Referring again to FIG. 1, the yarn carrier 10 is adapted to be mounted on a winding machine and have a yarn wound thereon. To wind the yarn onto the carrier, a color coded insert having the correct color for the particular yarn is selected and inserted radially into the opening. A free end of the yarn Y is caught in the notch and the carrier is mounted onto the spindles 12, 13 of the winding machine. The carrier is then rotated to draw yarn through the yarn guide 14 and onto the peripheral wall of the yarn carrier as the guide 14 reciprocates on the guide shaft 15 along the length of the carrier to form a yarn package 60. It should be noted, however, that the yarn is wound onto the carrier such that the insert is exposed and clearly visible when the package is formed, and as best seen in FIG. 6.

When the yarn has been removed from the carrier at for example a knitting mill, it may be returned to the yarn producer who can then readily adapt the carrier for a new and different yarn by changing the disc. Thus, the present invention facilitates the repetitive use of the carrier.

The foregoing description is to be considered illustrative rather than restrictive of the invention, and those modifications which come within the meaning and range of equivalence of the claims are to be included therein.

That which is claimed:

1. A yarn carrier adapted to be mounted on a winding machine and have a yarn wound thereon to form a yarn package, said yarn carrier comprising a tube having opposite ends and a peripheral wall for receiving the yarn to be wound thereon;

yarn catching and identifying means for retaining a free end of the yarn to be wound upon said peripheral wall and for identifying a particular characteristic of the yarn, said yarn catching and identifying means comprising (a) an opening extending radially through said peripheral wall and communicating with one of said ends; and (b) an insert removably received in said opening, with said opening and insert being configured to define at least one yarn engaging notch which is formed between the peripheries of said opening and said insert and which opens toward said one end of said tube, so that a free end of the yarn can be quickly and easily caught and retained in said notch, and wherein said insert includes visual indicium means for readily identifying a particular characteristic of the yarn to be wound upon said tube.

2. The yarn carrier according to claim 1 wherein said visual indicium means comprises a predetermined color.

3. The yarn carrier according to claim 1 wherein said insert is shaped as a circular disc and said opening is of generally circular shape with a portion open to said one end so that said insert fits securely in said opening and a pair of said notches are formed and which are spaced apart along the periphery of said insert and which face in opposite circumferential directions.

4. The yarn carrier of claim 3 wherein said disc shaped insert has a groove around the outer peripheral edge thereof and said opening has an internal wall portion which has an inwardly directed annular ridge which is received within said groove in said outer peripheral edge of said insert so that said insert is securely and releasably received in said opening.

5. The yarn carrier of claim 4 wherein said disc shaped insert has generally planar opposite faces, and a thickness not greater than that of said peripheral wall of said tube and such that said insert is substantially flush with said peripheral wall.

6. The yarn carrier of claim 1 wherein said peripheral wall of said tube is cylindrical.

7. A yarn carrier adapted to be mounted on a winding machine and have a yarn wound thereon to form a yarn package, said yarn carrier comprising a tube having opposite ends and a peripheral wall for receiving the yarn to be wound thereon;

yarn catching and identifying means for retaining a free end of the yarn to be wound upon said peripheral wall and for identifying a particular characteristic of the yarn, said yarn catching and identifying means comprising (a) an opening extending radially through said peripheral wall adjacent one of said ends, said opening comprising a generally circular portion remote from said one end of said tube, a throat portion on the side of said circular portion adjacent said one end, and a V-shaped yarn guide surface portion extending from said throat portion to said one end; and (b) an insert removably received in said circular portion of said opening, and whereby said throat portion of said opening and said insert define a pair of oppositely directed yarn engaging notches which open toward said one end of said tube, so that a free end of the yarn can be quickly and easily caught and retained in either of said notches, and wherein said insert includes visual indicium means for readily identifying a particular characteristic of the yarn to be wound upon said tube.

8. The yarn carrier as defined in claim 7 wherein said insert is shaped as a circular disc, and said insert has a groove around the outer periphery thereof, and said circular portion of said opening has an internal wall portion which has an inwardly directed annular ridge which is received within said groove, and such that said insert may be removed from or inserted into said circular portion of said opening by a radial force.

9. The yarn carrier as defined in claim 8 wherein said insert has a thickness not greater than that of said peripheral wall, and such that said insert does not protrude above the outer surface of said peripheral wall.

10. A method of forming a wound yarn package having provision for identifying a particular characteristic of yarn in the yarn package, and comprising the steps of (a) providing a tubular yarn carrier having opposite ends, a peripheral wall and an opening extending radially through said peripheral wall and communicating with one of said ends;

(b) selecting an insert which identifies the yarn to be wound onto the carrier as having a particular characteristic by means of a visually apparent indicium on said insert, and with said insert being configured to be releasably received in said opening;

(c) inserting said insert into said opening so as to be releasably received therein, and such that the insert is substantially flush with said peripheral wall of said yarn carrier and such that at least one yarn engaging notch is formed between the peripheries of said opening and said insert and which opens toward said one open end of said tube;

(d) catching a free end of the yarn in said notch; and then (e) winding the yarn onto the carrier to form a yarn package and such that the insert is exposed and clearly visible to readily identify the yarn in the package as having said particular characteristic.

* * * * *